US011302129B1

(12) United States Patent
Whitsett et al.

(10) Patent No.: US 11,302,129 B1
(45) Date of Patent: Apr. 12, 2022

(54) COMPUTER AUTOMATED RETRIEVAL OF PREVIOUSLY KNOWN ACCESS CODE(S) FOR A SECURITY DEVICE CONTROLLING ACCESS

(71) Applicant: International Business Machines Corporation, Armonk, NY (US)

(72) Inventors: Montrez Whitsett, Austin, TX (US); Mark Daniel Rogalski, Leander, TX (US); Gregory Wayne Roberts, Pflugerville, TX (US); Pedro Cantu, Pflugerville, TX (US)

(73) Assignee: International Business Machines Corporation, Armonk, NY (US)

( * ) Notice: Subject to any disclaimer, the term of this patent is extended or adjusted under 35 U.S.C. 154(b) by 4 days.

(21) Appl. No.: 17/118,508

(22) Filed: Dec. 10, 2020

(51) Int. Cl.
*G07C 9/25* (2020.01)
*G07C 9/29* (2020.01)
*G07C 9/28* (2020.01)

(52) U.S. Cl.
CPC ..... *G07C 9/25* (2020.01); *G07C 9/28* (2020.01); *G07C 9/29* (2020.01)

(58) Field of Classification Search
CPC ... G07C 9/20; G07C 9/25; G07C 9/28; G07C 9/29
See application file for complete search history.

(56) References Cited

U.S. PATENT DOCUMENTS 4,802,217 A 1/1989 Michener
5,990,885 A 11/1999 Gopinath
10,085,135 B2 9/2018 Robertson
10,720,001 B1 * 7/2020 Grasberg ..... G07C 9/27
2002/0099945 A1 7/2002 McLintock
2018/0033226 A1 * 2/2018 Robertson ..... G07C 9/00571

FOREIGN PATENT DOCUMENTS

EP 2355050 A2 8/2011

OTHER PUBLICATIONS

Brisaboa, et al. "Compressed Representation of Dynamic Binary Relations with Applications", Information Systems, Jul. 11, 2017, 47 pages.

(Continued)

*Primary Examiner* — Laura A Gudorf
(74) *Attorney, Agent, or Firm* — Michael A. Petrocelli

(57) ABSTRACT

Automatic retrieval using an electronic device of a previously known access code for a security device which includes identifying, using a computer, a security mechanism based on a proximity of a user to the security mechanism. The proximity of the user to the security mechanism is determined using location services for a mobile device of the user and first historical data which indicates a location of the security mechanism. Second historical data is analyzed, in response to identifying the security mechanism. An identified access code is selected based on the analysis of the second historical data. The selecting of the identified access code includes a reference relationship between the reference content, the security mechanism, and the access code. The identified access code is provided to the mobile device of the user for communication to the user, for the user to enter the code on the security mechanism.

20 Claims, 9 Drawing Sheets

(56) References Cited

OTHER PUBLICATIONS

Gaysse et al., "Enabling security in embedded system using M.2 SSD", Design & Reuse, © 2020 Design And Reuse, 3 pages, <https://www.design-reuse.com/articles/47272/enabling-security-in-embedded-system-using-m-2-ssd.html>.
Mell et al., "The NIST Definition of Cloud Computing", National Institute of Standards and Technology, Special Publication 800-145, Sep. 2011, 7 pages.

* cited by examiner

COMPUTER AUTOMATED RETRIEVAL OF PREVIOUSLY KNOWN ACCESS CODE(S) FOR A SECURITY DEVICE CONTROLLING ACCESS

BACKGROUND

The present disclosure relates to computer automated retrieval of previously known access codes for a security device for entry by a user into a security device controlling access to a physical location or area. More specifically, the computer automated retrieval of previously known access codes enables the user to retrieve the access code for entry into a security device controlling access into a controlled area or facility for the user to gain access to the controlled area or facility, or secured space, controlled venue, locked device, secured unit, or the like.

In one example, a person visiting a secure location can require a code for a locking mechanism or security device, for example a gated area, an alarm code for a home, building or entry within a facility. A visitor may have a difficult time remembering the access code or locating the access code, for example, which has been saved in a mobile device or saved via a hard copy. In one example, a user may search for an access code that was sent to them or they sent in an electric communication, such as an email, or a text message. However, manually searching through electronic communications can be cumbersome and time consuming for a person trying to enter a code into a security device for entering a secure area or facility.

SUMMARY

The present disclosure recognizes the shortcomings and problems associated with current methods and systems for automatic retrieval, using a mobile device, of a previously known access code for a security device when entering a secure area, facility, or location. The present invention details finding and providing previously known access codes to a user when the user is approaching or attempting to enter a secure area or location by entering a security code into a security device to enter a secure area. Thereby, the present invention prevents delays in entering a secure area or location and/or assists a user in entering the secure area, by automatically assisting the user to retrieve an access code by using a user's mobile device.

In one example, the present invention can help users to obtain needed physical access credentials quickly through the use of an automated system accessed using a user's mobile device. The method and system can use a geographical mapping service to determine a user's proximity to a controlled facility which has an access mechanism or device requiring an access code to enter the controlled facility. The method and system can examine data on a user's mobile device to locate a probable access code for the device to enter the facility, and then can provide the user with the access code via a notification.

In an aspect according to the present invention, a computer-implemented method for automatic retrieval, using a mobile device, of a previously known access code for a security device, includes identifying, using a computer, a security mechanism based on a proximity of a user to the security mechanism. The proximity of the user to the security mechanism is determined using location services for a mobile device of the user and first historical data which indicates a location of the security mechanism. The method includes analyzing second historical data, in response to identifying the security mechanism, and the analysis of the second historical data to identify an access code related to the security mechanism at the location. The second historical data includes content data from communications by the user, and the analysis of the second historical data includes matching reference content from the content data to an access code for the security mechanism. The method includes selecting an identified access code based on the analysis of the second historical data. The selecting of the identified access code includes a reference relationship between the reference content, the security mechanism, and the access code, wherein the access code is referenced as being for the security mechanism. The method includes providing the identified access code to the mobile device of the user for communication to the user, for the user to enter the code on the security mechanism.

In a related aspect, the method further includes receiving at the computer, historical data of user locations via the mobile device of the user.

In a related aspect, the security mechanism is one of a plurality of security mechanism, and the method further includes recording, using the computer, access codes related to the plurality of security mechanisms each requiring an access code at a respective physical location, and used by the user.

In a related aspect, the method includes receiving the location of the mobile device to determine a location of the user; analyzing the first historical data to determine a location of the security mechanism; and analyzing the location of the user and the location of the security mechanism to determine the proximity of the user to the security mechanism.

In a related aspect, the analyzing of the second historical data is in response to the location of the user meeting a threshold for proximity to a security mechanism of a plurality of security mechanisms.

In a related aspect, the analysis of the second historical data includes analyzing communications on the mobile device of the user.

In a related aspect, the communications are from a group consisting of: SMS, Email, Instant messages, navigation software.

In a related aspect the analyzing of the second historical data includes finding an access code based on a criteria, the criteria including a plurality of factors for matching reference content from the content data referencing the security mechanism to a code, and selecting a matched access code based on the criteria for the security mechanism.

In a related aspect, identifying the access code includes using natural language processing for the analyzing of the second historical data to identify the access code in a message about the security mechanism from a communication by the user using the mobile device.

In a related aspect, the providing of the identified access code to the mobile device of the user for communication to the user, is for the user to enter the code on the security mechanism; in response to the identified access code being communicated to the user, the user entering the access code, and in response to the user entering the access code the security mechanism being opened and/or a secure area or venue being accessed which is secured by the security mechanism.

In a related aspect, the method further includes communicating the access code to the user using the mobile device; and displaying the access code on a screen of the mobile device.

In a related aspects, the method further includes identifying a plurality of access codes using the analysis of the second historical data; based on criteria, weighting each of the identified codes for accuracy of being a correct code for the security mechanism; and selecting an access code from the plurality of access codes having meeting a threshold for the weighting for accuracy.

In a related aspect, the criteria includes determining a latest incident of communication for a code in the communications by the user, and/or determining a definitive expression of the code in a communication of the communication by the user.

In a related aspect, evaluating the access codes for a highest probability of being a correct code for the security mechanism using a plurality of factors as part of the criteria; determining a code of the plurality of codes with a highest probability of being a correct code based on the factors; and selecting the access code with the highest probability.

In a related aspect, the plurality of factors include using natural language processing to match a code in a message to the security mechanism.

In a related aspect, the code is a plurality of numbers.

In a related aspect, the security mechanism is securing a door or a gate.

In a related aspect, the security mechanism is securing access to a controlled facility or venue.

In another aspect according to the present invention, a system for automatic retrieval, using a mobile device, of a previously known access code for a security device includes a computer system. The computer system includes a computer processor, a computer-readable storage medium, and program instructions stored on the computer-readable storage medium being executable by the processor, to cause the computer system to perform functions, by the computer, comprising, the following functions to: identify, using a computer, a security mechanism based on a proximity of a user to the security mechanism, the proximity of the user to the security mechanism being determined using location services for a mobile device of the user and first historical data which indicates a location of the security mechanism; analyze second historical data, in response to identifying the security mechanism, the analysis of the second historical data to identify an access code related to the security mechanism at the location, the second historical data including content data from communications by the user, and the analysis of the second historical data including matching reference content from the content data to an access code for the security mechanism; select an identified access code based on the analysis of the second historical data, the selecting of the identified access code including a reference relationship between the reference content, the security mechanism, and the access code, wherein the access code is referenced as being for the security mechanism; and provide the identified access code to the mobile device of the user for communication to the user, for the user to enter the code on the security mechanism.

In another aspect according to the present invention, a computer program product for automatic retrieval, using a mobile device, of a previously known access code for a security device includes a computer readable storage medium having program instructions embodied therewith. The program instructions are executable by a computer to cause the computer to perform functions, by the computer, comprising the functions to: identify, using a computer, a security mechanism based on a proximity of a user to the security mechanism, the proximity of the user to the security mechanism being determined using location services for a mobile device of the user and first historical data which indicates a location of the security mechanism; analyze second historical data, in response to identifying the security mechanism, the analysis of the second historical data to identify an access code related to the security mechanism at the location, the second historical data including content data from communications by the user, and the analysis of the second historical data including matching reference content from the content data to an access code for the security mechanism; select an identified access code based on the analysis of the second historical data, the selecting of the identified access code including a reference relationship between the reference content, the security mechanism, and the access code, wherein the access code is referenced as being for the security mechanism; and provide the identified access code to the mobile device of the user for communication to the user, for the user to enter the code on the security mechanism.

BRIEF DESCRIPTION OF THE SEVERAL VIEWS OF THE DRAWINGS

These and other objects, features and advantages of the present invention will become apparent from the following detailed description of illustrative embodiments thereof, which is to be read in connection with the accompanying drawings. The various features of the drawings are not to scale as the illustrations are for clarity in facilitating one skilled in the art in understanding the invention in conjunction with the detailed description. The drawings are discussed forthwith below.

DETAILED DESCRIPTION

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces unless the context clearly dictates otherwise.

Figure 1:
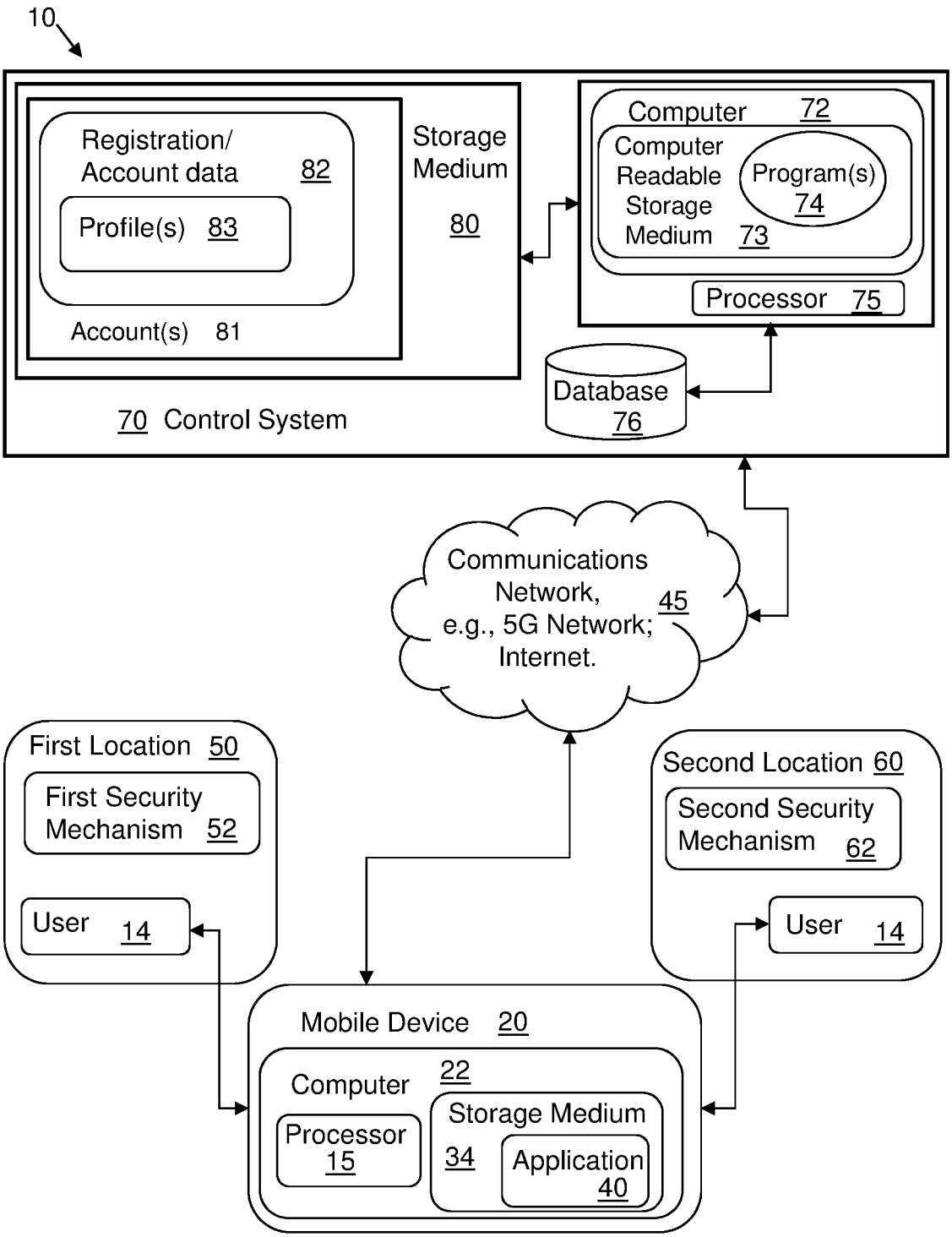
FIG. 1 is a schematic block diagram illustrating an overview of a system, system features or components, and methodology for automatic retrieval, using a mobile device, of a previously known access code for a security device, according to an embodiment of the invention.
Figure 2:
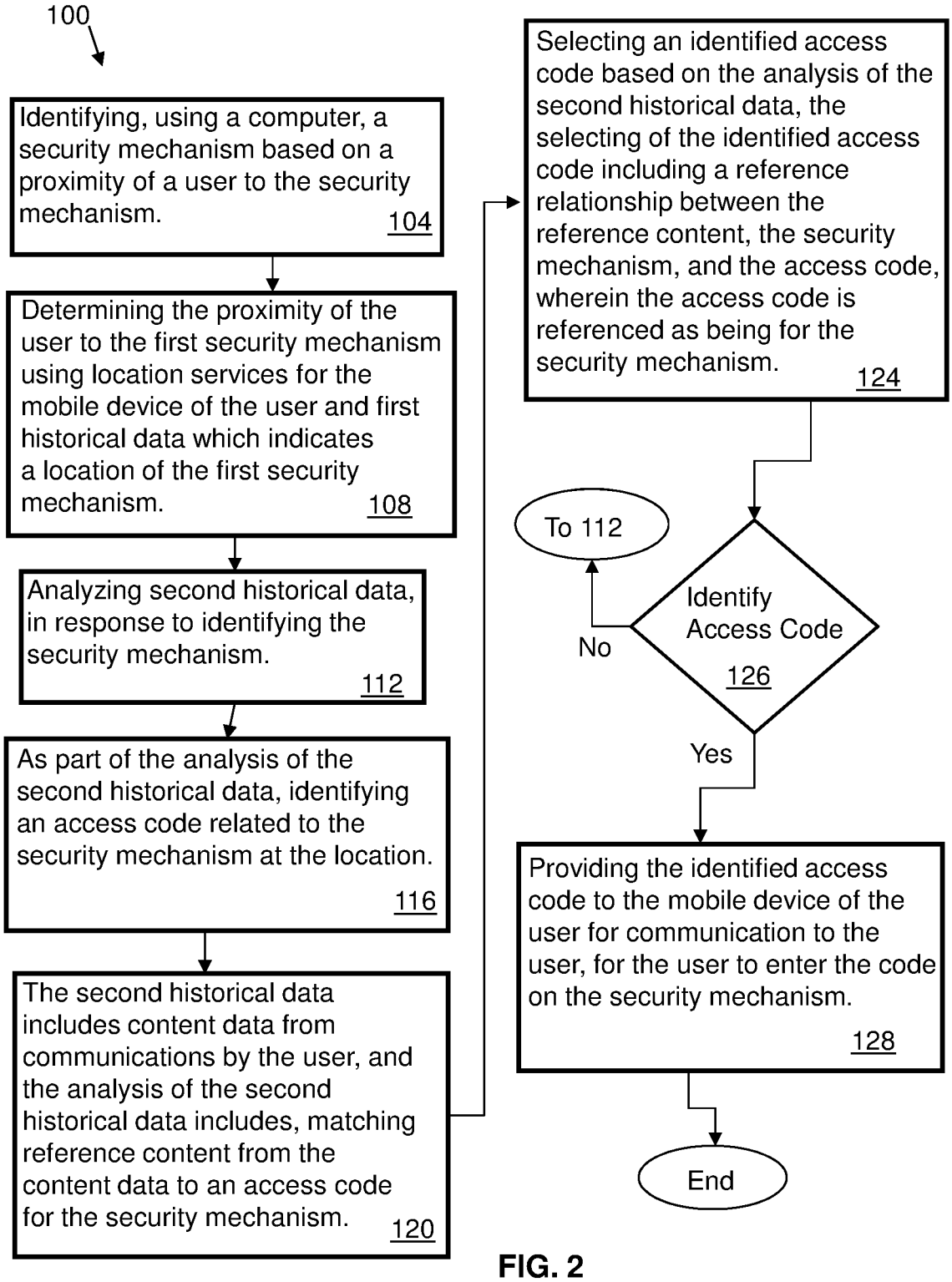
FIG. 2 is a flow chart illustrating a method and method functions, showing a series of operations, implemented using the system shown in FIG. 1, for automatic retrieval, using a mobile device, of a previously known access code for a security device, according to an embodiment of the present invention.

Referring to FIGS. 1 and 2, a method 100 (FIG. 2) with reference to a system 10 (FIG. 1) according to an embodiment of the present disclosure is provided for automatic retrieval, using an electronic device, of a previously known access code for a security mechanism or device. Security mechanism and security device are used interchangeably herein. The security device controls access to a secure location or area. The security device requires an access code for entry into the device by a user, upon entry of the access code, or in response to entering the access code into the security device, the device opens or allows access to the secure area.

The embodiment and examples herein can refer to one or more security mechanism accessed by the user; however, a user can access a plurality of security mechanisms. Further the security mechanism can be of many different types for different types of security. For example, but not limited to, a home security system, or a gate code for accessing a driveway, a venue, or a commercial space.

Referring to FIG. 2, the method 100 includes identifying, using a computer 22, a security mechanism, for example first security mechanism 52, based on a proximity 312 (FIG. 5) of a user to the security mechanism, described as a first location 50, as in block 104. In the embodiment of the present disclosure shown in FIG. 1, a first security mechanism 52 located at a first location 50 and a second security mechanism 62 is located at a second location 60. In the embodiment shown in FIG. 1, two locations and respective security mechanisms are shown for illustrative purposes, however, the present disclosure can be applied to a plurality of locations and/or security mechanism, including, for example, multiple security mechanisms at one or more locations. For convenience, the embodiment below refers to the first location 50 and the first security mechanism 52, however, similar features apply to the second location 60 and the second security mechanism 62, likewise, other security mechanisms can have similar features.

Figure 7:
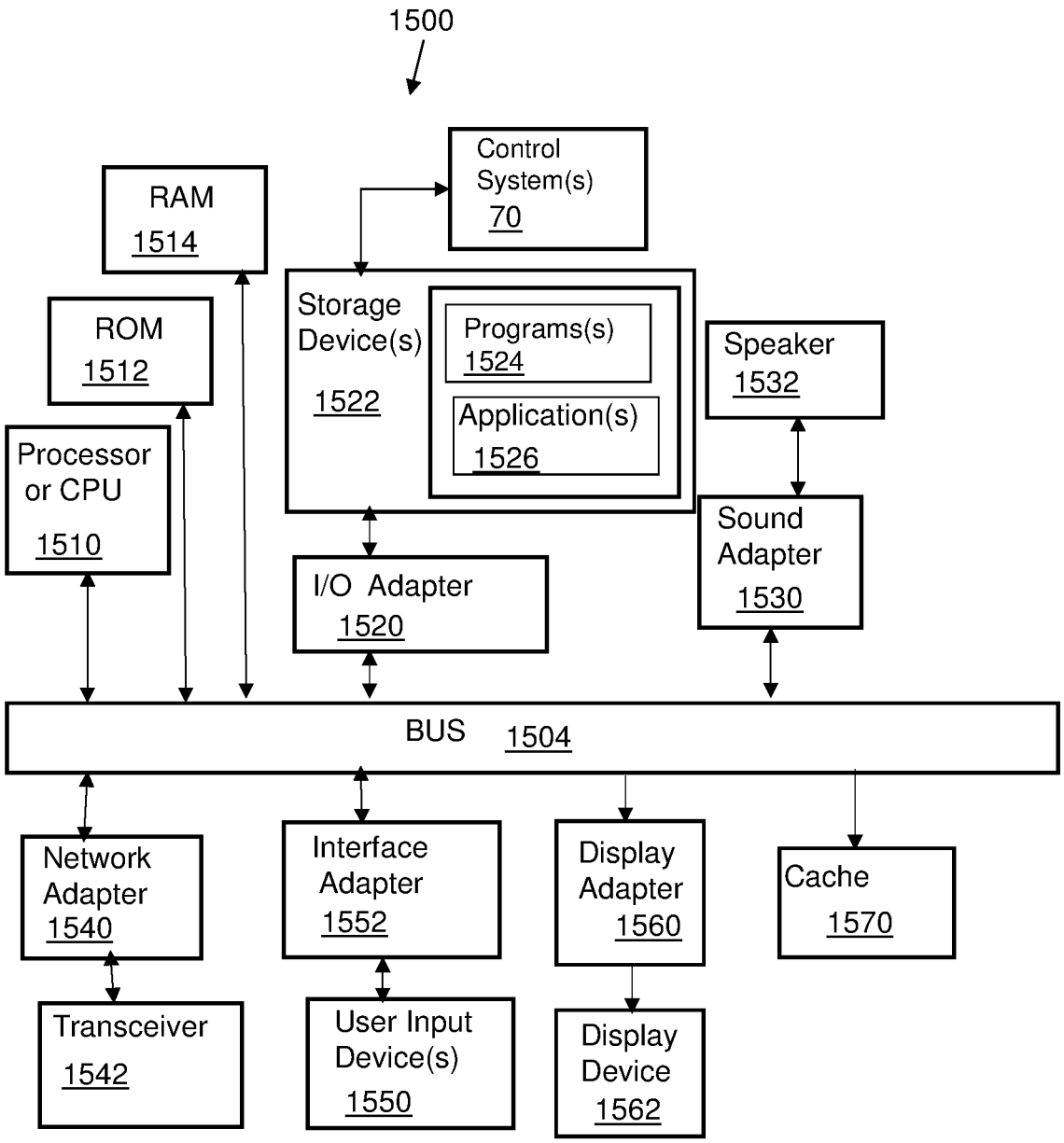
FIG. 7 is a schematic block diagram of a system depicting system components interconnected using a bus. The components for use, in all or in part, with the embodiments of the present disclosure, in accordance with one or more embodiments of the present disclosure.

In the embodiment of the present disclosure shown in FIGS. 1 and 2, a computer can be part of a remote computer or a remote server, for example, remote server 1100 (FIG. 7). In another example, the computer 72 can be part of a control system 70 and provide execution of the functions of the present disclosure. In another embodiment, a computer 22 can be part of a mobile device 20 and provide execution of the functions of the present disclosure. In still another embodiment, parts of the execution of functions of the present disclosure can be shared between the control system computer and the mobile device computer, for example, the control system function as a back end of a program or programs embodying the present disclosure and the mobile device computer functioning as a front end of the program or programs.

The proximity 312 of the user to the security mechanism can be determined using location services 304 (See FIG. 5) for a mobile device of the user and first historical data 308 which indicates a location of the security mechanism thus identifying 316 the security mechanism by its location. For example, a user can have access codes for one or more security mechanisms. The first historical data can record a location of the security mechanisms by entry from the user. In another example, Artificial Intelligence (AI) can be used to track a user's location when accessing a security system, for example, when entering a user's home, or business, or secure area or location/venue. In another example, the security mechanism can be identified by a name or type of the security mechanism, for example, home security, or gate security or device. Such identification, for example, can be entered by the user or labeled by tracking or AI tracking by use of the user using the security mechanism. Such identification of a security mechanism or device can be useful when electronically searching for reference to a security mechanism/device, security location, or entry area, for example, home or driveway gate. For example, a method can include search communications by the user which reference a location and/or a security mechanism identification or label, and/or a location of the user, and/or entry into a specific location, structure, building, or area.

The computer can be part of the mobile device, or a remote computer communicating with the mobile device. In another example, a mobile device and a remote computer can work in combination to implement the method of the present disclosure using stored program code or instructions to execute the features of the method(s) described herein. In one example, the mobile device 20 can include a computer 22 having a processor 15 and a storage medium 34 which stores an application 40. The application can incorporate program instructions for executing the features of the present disclosure using the processor 15. In another example, the mobile device 20 application 40 can have program instructions executable for a front end of a software application incorporating the features of the method of the present disclosure in program instructions, while a back end program or programs 74, of the software application, stored on the computer 72 of the control system 70 communicates with the mobile device computer and executes other features of the method. The control system 70 and the mobile device 20 can communicate using a communications network 45, for example, the Internet.

Thereby, the method 100 according to an embodiment of the present disclosure, can be incorporated in one or more computer programs or an application 40 stored on an electronic storage medium 34, and executable by the processor 15, as part of the computer on the mobile device 20. For example, a user 14 has a device 20, and the device can communicate with the control system 70. Other users (not shown) may have similar devices and communicate with the control system similarly. The application can be stored, all or in part, on a computer or a computer in a mobile device and at a control system communicating with the device, for example, using the communications network 45, such as the Internet. It is envisioned that the application can access all or part of program instructions to implement the method of the present disclosure. The program or application can communicate with a remote computer system via a communications network 45 (e.g., the Internet) and access data, and cooperate with program(s) stored on the remote computer system. Such interactions and mechanisms are described in further detail herein and referred to regarding components of a computer system, such as computer readable storage media, which are shown in one embodiment in FIG. 6 and described in more detail in regards thereto referring to one or more computer systems 1010.

Thus, in one example, a control system 70 is in communication with the device(s) 20, and the device 20 can include the application 40. The device 20 communicates with the control system 70 using the communications network 45.

In another example, the control system 70 can have a front-end computer belonging to one or more users, such as the device 20, and a back-end computer embodied as the control system.

Also, referring to FIG. 1, the device 20 can include a computer 22, computer readable storage medium 34, and operating systems, and/or programs, and/or a software application 40, which can include program instructions executable using a processor 15. These features are shown herein in FIG. 1, and also in an embodiment of a computer system shown in FIG. 6 referring to one or more computer systems 1010, which may include one or more generic computer components.

Again referring to FIG. 2, the proximity 312 of the user 14 to the first security mechanism 52 can be determined using location services for the mobile device 20 of the user 14 and first historical data which indicates a location of the first security mechanism 52, as in block 108. For example, location services on a mobile device can determine a location of a user, for example using a GPS (Global Positioning System). In one example, the first historical data can include data regarding locations visited by a user by tracking, with the consent of the user, movements, locations, frequently visited locations of the user. In another example, a user can enter security device locations into the application or program, along with user registration and a user profile, for the application or program to identify when the user is in the proximity of a security device. The application can identify when the user is in the proximity of a security device by comparing the location of the user to a location for a security device. Such proximity can be, for example, a threshold proximity or closeness, such as, a user being 5 feet or closer to a security device, or 10 feet or closer. In another example, a user location at or within a venue, for example, at an address, or at a store, home, office, business, etc.

The method includes analyzing 324 second historical data 320 (FIG. 5), in response to identifying the security mechanism, as in block 112. The analysis of the second historical data includes identifying an access code related to the security mechanism at the location, as in block 116. The second historical data includes content data 328 from communications by the user, and the analysis of the second historical data includes matching reference content 332 from the content data 328 to an access code for the security mechanism, as in block 120.

The method includes selecting an identified access code based on the analysis of the second historical data, as in block 124. The selecting of the identified access code 340 includes a reference relationship 336 between the reference content, the security mechanism, and the access code, wherein the access code is referenced as being for the security mechanism, as in block 124. For example, a reference relationship can refer to where in a communication from or to the user, an access code was referenced for the security mechanism. For instance, a communication may include text message using SMS (Short Message Service), and Email, instant messaging or navigation software, which may include an access code for the security mechanism.

In one example, the method and system can regularly access map data to determine that the user's current geolocation corresponds to a security device, such as a secure area, for instance, a gated driveway. The method and system can then check SMS, etc. looking for building addresses that are accessible via this gate, and then for access codes in the same message or a closely associated message (received from same user within a short timeframe). In one example, access codes can be identified as stand-alone 4 to 6 digit numbers (not part of an address or telephone number). In another example, an access code can be identified by noting proceeding keywords such as 'gate', 'code', access', etc., before a 4-6 digit code. Such a found access code can then be suggested to the user.

The location of the security mechanism can also be referred to as the proximity of the security mechanism or device, or an access control point, or a security location.

In one example, in response to the user accessing a communications method or technique, for example, SMS, Email, or electronic messaging, while at the security mechanism, the method and system can note or record data items, that is, the communications as probable sources of access codes for future access code searches. The notes or recorded data items can be used to populate a historical database.

Thus, as the method and system is used, and builds historical data of usage, it can more reliably associate known access codes with specific locations and can provide the access code earlier or faster. For example, the method and system could use the historical database to more rapidly search for an access code then searching all communications. In another example, the method and system could search the historical database first, and if an access code is not found, or no codes meeting a probability threshold are found, or a user rejects all codes found after searching the historical database, the method can continue to search all communications. The method can also provide an access code as soon as a user enters a destination address using a navigation application in anticipation of needing an access code.

When the user accesses SMS, Email, or messages while at an access-controlled point, that is, a security device, the method and system can note these data items as probable sources of access codes for future access code searches. Thereby, as the method and system is used, and can store historical data, more reliable associated known access codes with specific locations, can provide an access code earlier. In one example, the system and method could provide an access code as soon as you enter a destination address in a navigation application wherein the destination is associated with a security device.

When the method identifies an access code, as in block 126, as discussed above, the method proceeds to block 128. When the method does not identify an access code, at block 126, the method returns to block 112 to further analyze the second historical data and proceed as in the method 100 to identifying an access code based on the analysis.

The method includes providing 344 the identified access code 340 to the mobile device of the user for communication to the user, for the user to enter 348 the code on the security mechanism, as in block 128, thereby enabling access/entry to a secure area or location 352. For example, providing the identified access code can include sending a notification to the user. In another example, providing the identified access code can include displaying the code on a screen of the mobile device, and thereby displaying the code on the screen for the user to view. In another example, with authorization from the user, the identified code can be communicated audibly using the mobile device.

Figure 3:
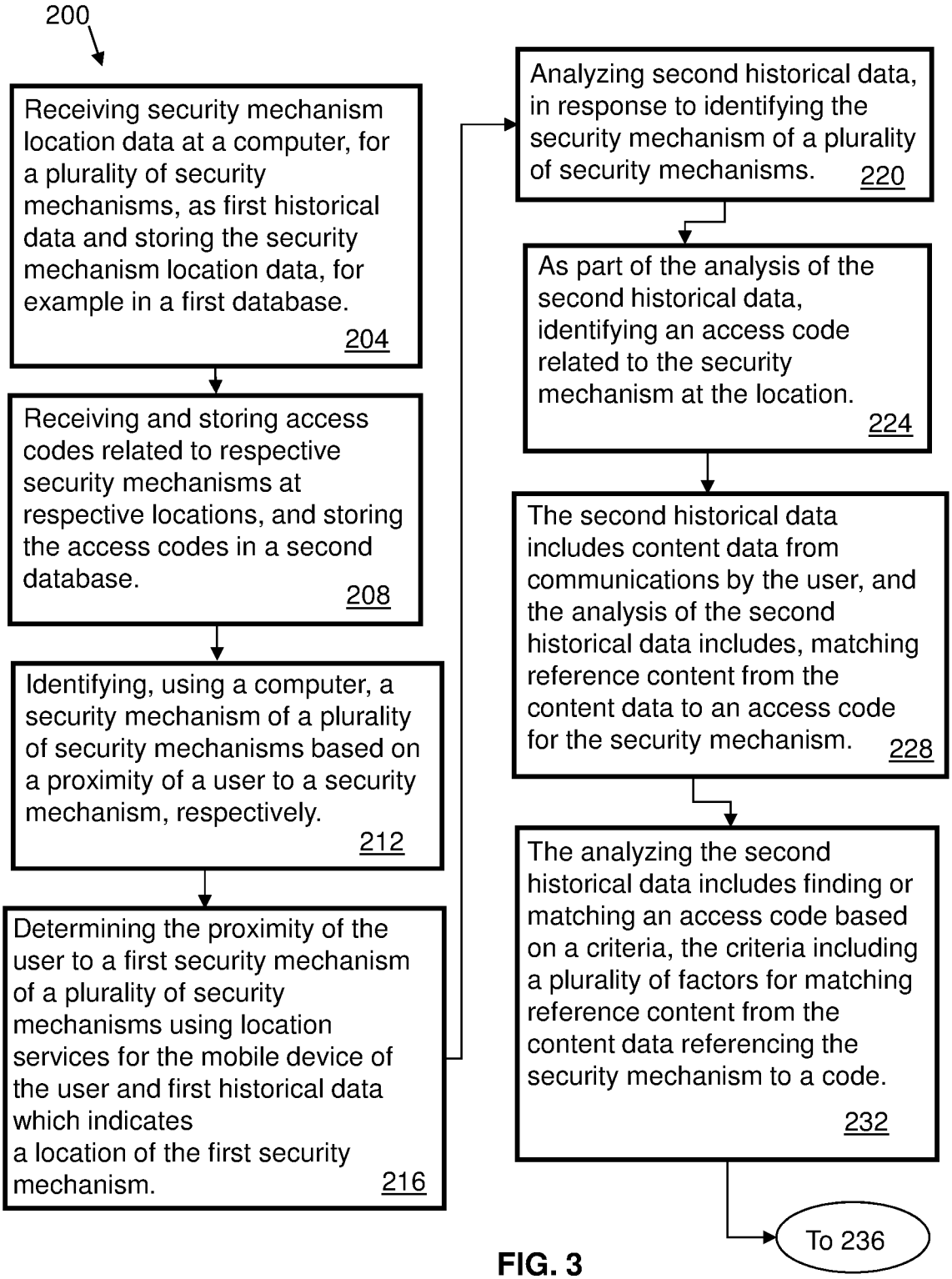
FIG. 3 is a flow chart illustrating another embodiment of a method according to the present disclosure, implemented using the system shown in FIG. 1, for automatic retrieval, using a mobile device, of a previously known access code for a security device.
Figure 4:
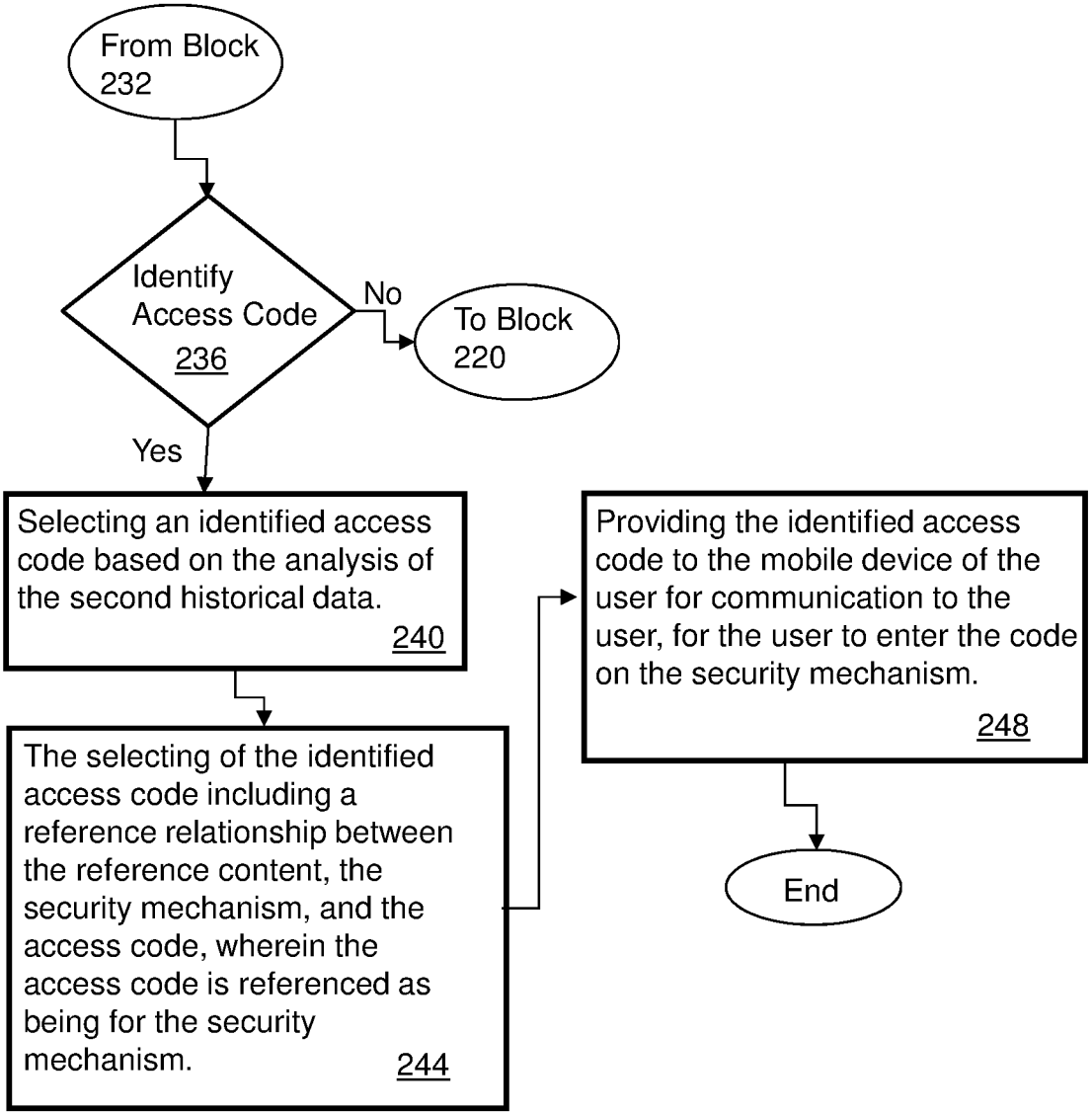
FIG. 4 is a flow chart continuing from the flow chart shown in FIG. 3 depicting a continuation of the method shown in FIG. 3, according to an embodiment of the invention.

Referring to FIG. 3, in another embodiment of a method 200 according to the present disclosure, some of the operations are similar and/or duplicative of the operations discussed according to the method 100 and shown in FIG. 2. The method 200 includes receiving security mechanism location data at a computer, for a plurality of security mechanisms, as first historical data and storing the security mechanism location data, as in block 204. In one example, the first historical data can be stored in a first database. In one example, the location data for the plurality of security mechanisms can be inputted by the user. In another example, location services and Artificial Intelligence (AI) can be used to track the user and when the user uses a security code, and thereby store locations of security devices and any communications regarding the access codes for the respective security devices.

The method 200 includes receiving and storing access codes related to the security mechanisms at respective locations, as in block 208. In one example, AI can be used to also collect and securely store access codes retrieved in communications, for example, storing all codes, such as a 4 to 6 digit codes, or all codes with a range of digits, identified, collected in communications. In another example, the system and method can detect a security code or access code, setting parameters of a range of digits, for example, 4-6 digits, and identify an access code in a communication. The identification can include detecting when the communication is related to the access code. For example, using natural language processing (NLP), the system and method can identify communications related to a security device, identify a code in the communication, and store the access code in a second database for a plurality of security mechanisms/devices and related access codes.

The method 200 includes identifying, using a computer, a security mechanism of a plurality of security mechanisms based on a proximity of a user to a security mechanism, respectively, as in block 212.

The method 200 includes determining the proximity of the user to a first security mechanism of the plurality of security mechanisms using location services for the mobile device of the user and the first historical data which indicates a location of the first security mechanism, as in block 216.

In one example according to the present disclosure, the method can include receiving the location of the mobile device to determine a location of the user. For example, the user's mobile device can indicate the location of the user. The method can analyze the first historical data to determine a location of the security mechanism. The method includes analyzing the location of the user and the location of the security mechanism to determine the proximity of the user to the security mechanism. For example, the location of the user can indicate the user is at or in front of a security mechanism or device. Such location services can include micro-location services. The proximity of a user to a security mechanism, can include defining proximity as within a specified distance range of a security device, such as within five feet or six feet, or from the location of the security device to ten feet of the security device, or a radius around a security device such as within a ten foot radius of a security device.

The method 200 includes analyzing second historical data, in response to identifying the security mechanism of a plurality of security mechanisms, as in block 220. The method 200 includes, as part of the analysis of the second historical data, identifying an access code related to the security mechanism at the location, as in block 224. The second historical data includes content data from communications by the user, and the analysis of the second historical data includes, matching reference content from the content data to an access code for the security mechanism, as in block 228, to identify an access code for a referenced security mechanism.

In one example, the analyzing the second historical data includes finding or matching an access code based on criteria, the criteria including a plurality of factors for matching reference content from the content data referencing the security mechanism to a code, as in block 232. The method can then select a matched access code based on the criteria for the security mechanism.

In response to identifying an access code, at block 236, the method 200 proceeds to block 240. In response to not identifying an access code, at block 236, the method 200 returns to block 220.

The method 200 includes selecting an identified access code based on the analysis of the second historical data, as in block 240. The selecting of the identified access code includes a reference relationship between the reference content, the security mechanism, and the access code, as in block 244. For example, reference content can be identified in communications of the user. The method can use NLP to search for and detect key words in one or more communications wherein one or more key words reference a security mechanism and includes an access code. Thereby, an identification can be determined, and the access code can be referenced as being for the security mechanism, as in block 244.

In one example, the system and method can identify an access code, for example, as discussed above, and determine a probability of the access code being for a referenced security mechanism. Such probability can be assessed by determining relevance of the reference content to a security mechanism. For example, NLP can be used to compare or match reference content to a security mechanism. In one example, if reference content directly references a security mechanism, for example, "your access code is 'blank', for 'blank' security mechanism". In this example, there is a high probability of the access code being correct for the referenced security mechanism. In another example, an access code may be less probably an access code. And in another example, a threshold can be set, by ranking or weighting such information or reference content referring to a security mechanism. Then, a threshold can be set based on the ranking or weighting for considering reference content as probable, or highly probable. Such examples are intended to be exemplary and non-exhaustive.

The method including providing 344 the identified access code 340 to the mobile device of the user for communication to the user, for the user to enter 348 the code on the security mechanism, as in block 248, and thereby enabling access/entry 352 of the user into the secure area or location.

In one example, the analyzing of the second historical data can be in response to the location of the user meeting a threshold for a proximity to a security mechanism of a plurality of security mechanisms. For example, meeting a proximity threshold for a proximity to a security mechanism can trigger analyzing the second historical data in response to meeting the threshold.

In one example, the analysis of the second historical data can include analyzing communications on the mobile device of the user.

In another example, the communications can be from a group consisting of: SMS, Email, Instant messages, navigation software.

In another example, identifying the access code can include using natural language processing for the analyzing of the second historical data to identify the access code in a message about the security mechanism from a communication by the user using the mobile device.

In another example, providing of the identified access code to the mobile device of the user for communication to the user, is for the user to enter the code on the security mechanism. In response to the identified access code being communicated to the user, the user enters the access code, and in response to the user entering the access code the security mechanism is opened and/or a secure area or venue being accessed or opened which is secured by the security mechanism.

In another example, the method according to the present disclosure can include communicating the access code to the user using the mobile device, and displaying the access code on a screen of the mobile device.

In another example, the method according to the present disclosure can include identifying a plurality of access codes using the analysis of the second historical data, and based on criteria, weighting each of the identified codes for accuracy of being a correct code for the security mechanism. The method can include selecting an access code from the plurality of access codes meeting a threshold for the weighting for accuracy.

In another example, the criteria can include determining a latest incident of communication for a code in the communications by the user, and/or determining a definitive expression of the code in a communication of the communication by the user.

In another example, the method according to the present disclosure, can include evaluating the access codes for a highest probability of being a correct code for the security mechanism using a plurality of factors as part of the criteria. The method includes determining a code of the plurality of codes with a highest probability of being a correct code based on the factors. The method includes selecting the access code with the highest probability.

In another example, the plurality of factors can include using natural language processing to match a code in a message to the security mechanism.

In another example, the code can be a plurality of numbers.

In one example, the security mechanism can be securing a door or a gate.

In another example, the security mechanism can be securing access to a controlled facility or venue.

According to the present disclosure, embodiments help users obtain needed physical access credentials quickly through the use of the automated methods and systems disclosed herein. In one embodiment, the method and system can use a geographical mapping service to determine a user's proximity to a controlled facility, then examines data on the user's device to locate a probable access code for the facility. The method and system can then provide the user with the access code via a notification.

Figure 5:
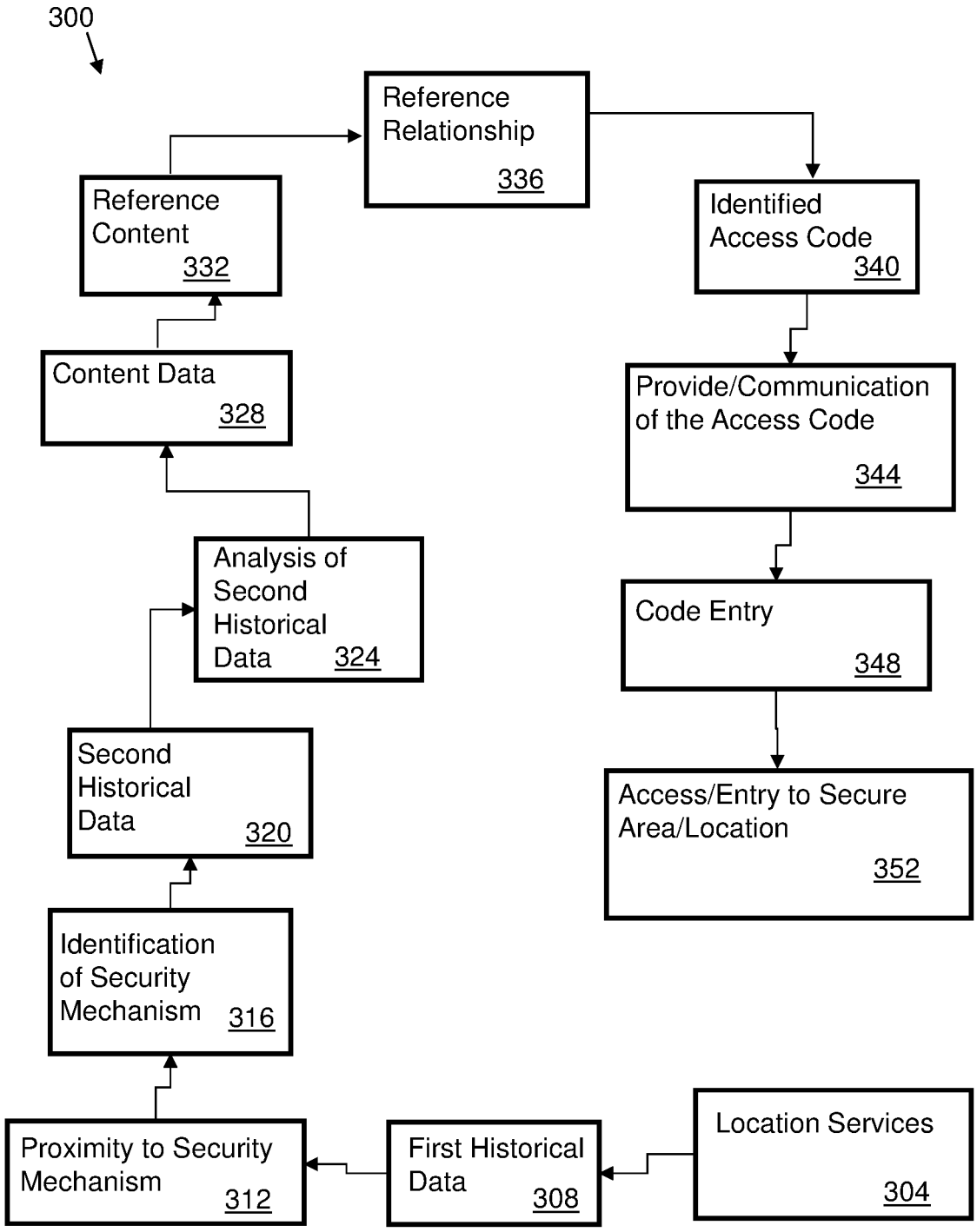
FIG. 5 is a functional schematic block diagram for instructional purposes illustrating functional features of the present disclosure associated with the embodiments shown in FIGS. 1, 2, 3, and 4, for automatic retrieval, using a mobile device, of a previously known access code for a security device.

It is understood that the features shown in FIG. 5 are functional representations of features of the present disclosure. Such features are shown in embodiments of the systems and methods of the present disclosure for illustrative purposes to clarify the functionality of features of the present disclosure.

The method according to the present disclosure, can include a computer for implementing the features of the method, according to the present disclosure, as part of a control system. In another example, a computer as part of a control system can work in corporation with a mobile device computer for implementing the features of the method according to the present disclosure. In another example, a computer for implementing the features of the method can be part of a mobile device and thus implement the method locally.

Specifically, regarding the control system 70, the device(s) 20 of one or more users 14 can be in communication with the control system 70 via the communications network 45. In the embodiment of the control system shown in FIG. 1, the control system 70 includes a computer 72 having a database 76 and one or more programs 74 stored on a computer readable storage medium 73. In the embodiment of the disclosure shown in FIG. 1, the device 20 communicates with the control system 70 and the one or more programs 74 stored on a computer readable storage medium 73. The control system includes the computer 72 having a processor 75, which also has access to the database 76.

The control system 70 includes a storage medium 80 for maintaining a registration 82 of users and their devices for content analysis. Such registration can include user profiles 83, which can include user data supplied by the users in reference to registering and setting-up an account. In an embodiment, the method and system which incorporates the present disclosure includes the control system (generally referred to as the back-end) in combination and cooperation with a front end of the method and system, which can be the application 40. In one example, the application 40 is stored on a device, for example, the device 20, and can access data and additional programs at a back end of the application, e.g., control system 70.

The control system can also be part of a software application implementation, and/or represent a software application having a front-end user part and a back-end part providing functionality. In an embodiment, the method and system which incorporates the present disclosure includes the control system (which can be generally referred to as the back-end of the software application which incorporates a part of the method and system of an embodiment of the present application) in combination and cooperation with a front end of the software application incorporating another part of the method and system of the present application at the device, as in the example shown in FIG. 1 of device 20 having the application 40. The application 40 is stored on the device 20 and can access data and additional programs at the back end of the application, for example, in the program(s) 74 stored in the control system 70.

The program(s) 74 can include, all or in part, a series of executable steps for implementing the method of the present disclosure. A program, incorporating the present method, can be all or in part stored in the computer readable storage medium on the control system or, in all or in part, on a device 20. It is envisioned that the control system 70 can not only store the profile of users, but in one embodiment, can interact with a website for viewing on a display of a device, or in another example the Internet, and receive user input related to the method and system of the present disclosure. It is understood that FIG. 1 depicts one or more profiles 83, however, the method can include multiple profiles, users, registrations, etc. It is envisioned that a plurality of users or a group of users can register and provide profiles using the control system for use according to the method and system of the present disclosure.

Regarding collection of data with respect to the present disclosure, such uploading or generation of profiles is voluntary by the one or more users, and thus initiated by and with the approval of a user. Thereby, a user can opt-in to establishing an account having a profile according to the present disclosure. Such approval also includes a user's option to cancel such profile or account, and thus opt-out, at the user's discretion, of capturing communications and data. Further, any data stored or collected is understood to be intended to be securely stored and unavailable without authorization by the user, and not available to the public and/or unauthorized users. Such stored data is understood to be deleted at the request of the user and deleted in a secure manner. Also, any use of such stored data is understood to be, according to the present disclosure, only with the user's authorization and consent.

In one or more embodiments of the present invention, a user(s) can opt-in or register with a control system, voluntarily providing data and/or information in the process, with the user's consent and authorization, where the data is stored and used in the one or more methods of the present disclosure. Also, a user(s) can register one or more user electronic devices for use with the one or more methods and systems according to the present disclosure. As part of a registration, a user can also identify and authorize access to one or more activities or other systems (e.g., audio and/or video systems). Such opt-in of registration and authorizing collection and/or storage of data is voluntary and a user may request deletion of data (including a profile and/or profile data), un-registering, and/or opt-out of any registration. It is understood that such opting-out includes disposal of all data in a secure manner.

In another example, the control system 70 can be all or part of an Artificial Intelligence (AI) system. For example, the control system can be one or more components of an AI system.

It is also understood that the method 100 according to an embodiment of the present disclosure, can be incorporated into (Artificial Intelligence) AI devices, which can communicate with respective AI systems, and respective AI system platforms. Thereby, such programs or an application incorporating the method of the present disclosure, as discussed above, can be part of an AI system. In one embodiment according to the present invention, it is envisioned that the control system can communicate with an AI system, or in another example can be part of an AI system. The control system can also represent a software application having a front-end user part and a back-end part providing functionality, which can in one or more examples, interact with, encompass, or be part of larger systems, such as an AI system. In one example, an AI device can be associated with an AI system, which can be all or in part, a control system and/or a content delivery system, and be remote from an AI device. Such an AI system can be represented by one or more servers storing programs on computer readable medium which can communicate with one or more AI devices. The AI system can communicate with the control system, and in one or more embodiments, the control system can be all or part of the AI system or vice versa.

It is understood that as discussed herein, a download or downloadable data can be initiated using a voice command or using a mouse, touch screen, etc. In such examples a mobile device can be user initiated, or an AI device can be used with consent and permission of users. Other examples of AI devices include devices which include a microphone, speaker, and can access a cellular network or mobile network, a communications network, or the Internet, for example, a vehicle having a computer and having cellular or satellite communications, or in another example, IoT (Internet of Things) devices, such as appliances, having cellular network or Internet access.

Figure 6:
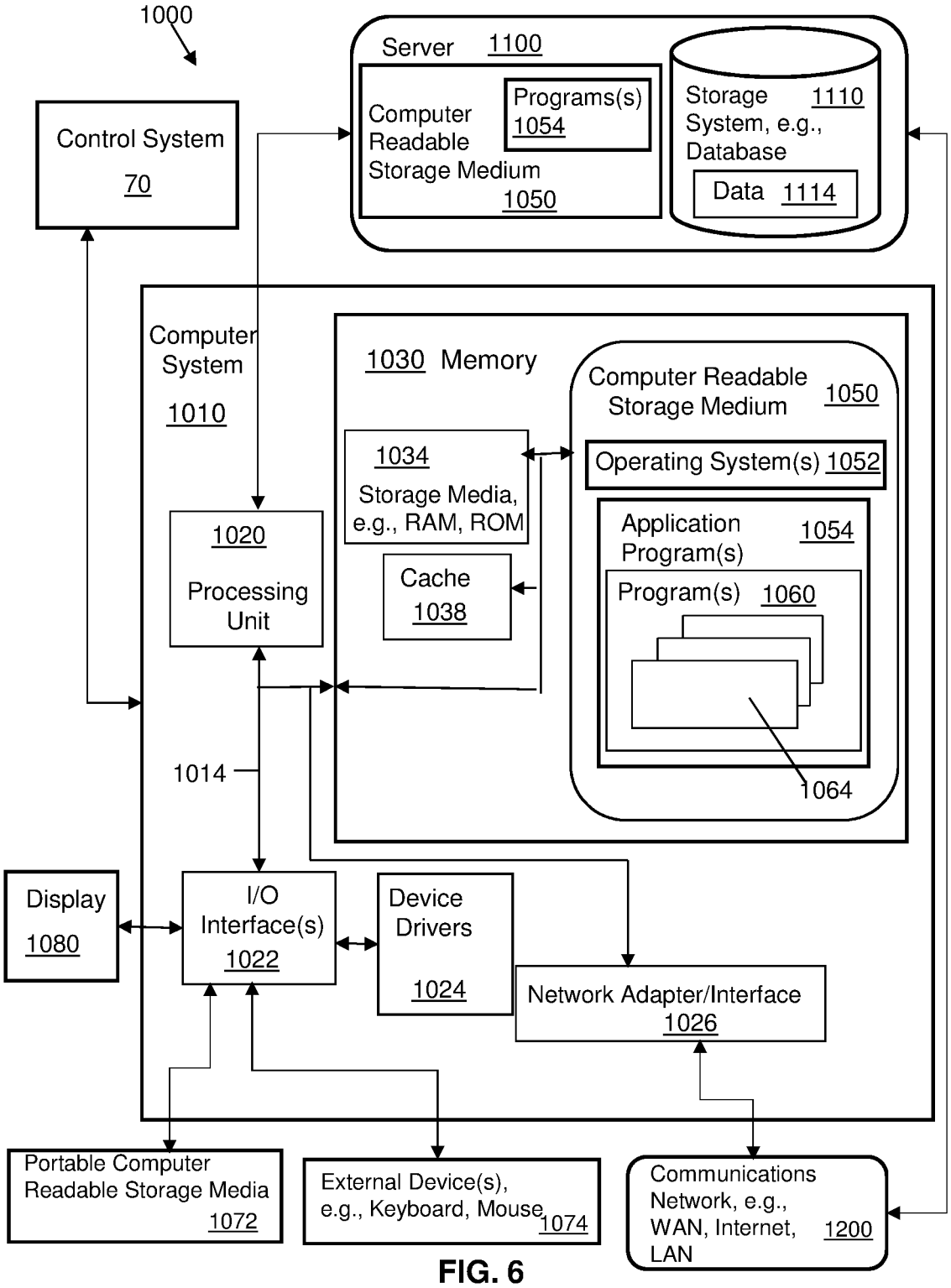
FIG. 6 is a schematic block diagram depicting a computer system according to an embodiment of the disclosure which may be incorporated, all or in part, in one or more computers or devices shown in FIG. 1, and cooperates with the systems and methods shown in FIGS. 1, 2, 3, 4, and 5.

Referring to FIG. 6, a an embodiment of system or computer environment 1000, according to the present disclosure, includes a computer system 1010 shown in the form of a generic computing device. The method 100, for example, may be embodied in a program 1060, including program instructions, embodied on a computer readable storage device, or a computer readable storage medium, for example, generally referred to as computer memory 1030 and more specifically, computer readable storage medium 1050. Such memory and/or computer readable storage media includes non-volatile memory or non-volatile storage, also known and referred to non-transient computer readable storage media, or non-transitory computer readable storage media. For example, such non-volatile memory can also be disk storage devices, including one or more hard drives. For example, memory 1030 can include storage media 1034 such as RAM (Random Access Memory) or ROM (Read Only Memory), and cache memory 1038. The program 1060 is executable by the processor 1020 of the computer system 1010 (to execute program steps, code, or program code). Additional data storage may also be embodied as a database 1110 which includes data 1114. The computer system 1010 and the program 1060 are generic representations of a computer and program that may be local to a user, or provided as a remote service (for example, as a cloud based service), and may be provided in further examples, using a website accessible using the communications network 1200 (e.g., interacting with a network, the Internet, or cloud services). It is understood that the computer system 1010 also generically represents herein a computer device or a computer included in a device, such as a laptop or desktop computer, etc., or one or more servers, alone or as part of a datacenter. The computer system can include a network adapter/interface 1026, and an input/output (I/O) interface(s) 1022. The I/O interface 1022 allows for input and output of data with an external device 1074 that may be connected to the computer system. The network adapter/interface 1026 may provide communications between the computer system a network generically shown as the communications network 1200.

The computer 1010 may be described in the general context of computer system-executable instructions, such as program modules, being executed by a computer system. Generally, program modules may include routines, programs, objects, components, logic, data structures, and so on that perform particular tasks or implement particular abstract data types. The method steps and system components and techniques may be embodied in modules of the program 1060 for performing the tasks of each of the steps of the method and system. The modules are generically represented in the figure as program modules 1064. The program 1060 and program modules 1064 can execute specific steps, routines, sub-routines, instructions or code, of the program.

The method of the present disclosure can be run locally on a device such as a mobile device, or can be run a service, for instance, on the server 1100 which may be remote and can be accessed using the communications network 1200. The program or executable instructions may also be offered as a service by a provider. The computer 1010 may be practiced in a distributed cloud computing environment where tasks are performed by remote processing devices that are linked through a communications network 1200. In a distributed cloud computing environment, program modules may be located in both local and remote computer system storage media including memory storage devices.

More specifically, the system or computer environment 1000 includes the computer system 1010 shown in the form of a general-purpose computing device with illustrative periphery devices. The components of the computer system 1010 may include, but are not limited to, one or more processors or processing units 1020, a system memory 1030, and a bus 1014 that couples various system components including system memory 1030 to processor 1020.

The bus 1014 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

The computer 1010 can include a variety of computer readable media. Such media may be any available media that is accessible by the computer 1010 (e.g., computer system, or server), and can include both volatile and non-volatile media, as well as, removable and non-removable media. Computer memory 1030 can include additional computer readable media in the form of volatile memory, such as random access memory (RAM) 1034, and/or cache memory 1038. The computer 1010 may further include other removable/non-removable, volatile/non-volatile computer storage media, in one example, portable computer readable storage media 1072. In one embodiment, the computer readable storage medium 1050 can be provided for reading from and writing to a non-removable, non-volatile magnetic media. The computer readable storage medium 1050 can be embodied, for example, as a hard drive. Additional memory and data storage can be provided, for example, as the storage system 1110 (e.g., a database) for storing data 1114 and communicating with the processing unit 1020. The database can be stored on or be part of a server 1100. Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 1014 by one or more data media interfaces. As will be further depicted and described below, memory 1030 may include at least one program product which can include one or more program modules that are configured to carry out the functions of embodiments of the present invention.

The method(s) described in the present disclosure, for example, may be embodied in one or more computer programs, generically referred to as a program 1060 and can be stored in memory 1030 in the computer readable storage medium 1050. The program 1060 can include program modules 1064. The program modules 1064 can generally carry out functions and/or methodologies of embodiments of the invention as described herein. The one or more programs 1060 are stored in memory 1030 and are executable by the processing unit 1020. By way of example, the memory 1030 may store an operating system 1052, one or more application programs 1054, other program modules, and program data on the computer readable storage medium 1050. It is understood that the program 1060, and the operating system 1052 and the application program(s) 1054 stored on the computer readable storage medium 1050 are similarly executable by the processing unit 1020. It is also understood that the application 1054 and program(s) 1060 are shown generically, and can include all of, or be part of, one or more applications and program discussed in the present disclosure, or vice versa, that is, the application 1054 and program 1060 can be all or part of one or more applications or programs which are discussed in the present disclosure. It is also understood that a control system 70, communicating with a computer system, can include all or part of the computer system 1010 and its components, and/or the control system can communicate with all or part of the computer system 1010 and its components as a remote computer system, to achieve the control system functions described in the present disclosure. The control system function, for example, can include storing, processing, and executing software instructions to perform the functions of the present disclosure. It is also understood that the one or more computers or computer systems shown in FIG. 1 similarly can include all or part of the computer system 1010 and its components, and/or the one or more computers can communicate with all or part of the computer system 1010 and its components as a remote computer system, to achieve the computer functions described in the present disclosure.

In an embodiment according to the present disclosure, one or more programs can be stored in one or more computer readable storage media such that a program is embodied and/or encoded in a computer readable storage medium. In one example, the stored program can include program instructions for execution by a processor, or a computer system having a processor, to perform a method or cause the computer system to perform one or more functions. For example, in one embedment according to the present disclosure, a program embodying a method is embodied in, or encoded in, a computer readable storage medium, which includes and is defined as, a non-transient or non-transitory computer readable storage medium. Thus, embodiments or examples according to the present disclosure, of a computer readable storage medium do not include a signal, and embodiments can include one or more non-transient or non-transitory computer readable storage mediums. Thereby, in one example, a program can be recorded on a computer readable storage medium and become structurally and functionally interrelated to the medium.

The computer 1010 may also communicate with one or more external devices 1074 such as a keyboard, a pointing device, a display 1080, etc.; one or more devices that enable a user to interact with the computer 1010; and/or any devices (e.g., network card, modem, etc.) that enables the computer 1010 to communicate with one or more other computing devices. Such communication can occur via the Input/Output (I/O) interfaces 1022. Still yet, the computer 1010 can communicate with one or more networks 1200 such as a local area network (LAN), a general wide area network (WAN), and/or a public network (e.g., the Internet) via network adapter/interface 1026. As depicted, network adapter 1026 communicates with the other components of the computer 1010 via bus 1014. It should be understood that although not shown, other hardware and/or software components could be used in conjunction with the computer 1010. Examples, include, but are not limited to: microcode, device drivers 1024, redundant processing units, external disk drive arrays, RAID systems, tape drives, and data archival storage systems, etc.

It is understood that a computer or a program running on the computer 1010 may communicate with a server, embodied as the server 1100, via one or more communications networks, embodied as the communications network 1200. The communications network 1200 may include transmission media and network links which include, for example, wireless, wired, or optical fiber, and routers, firewalls, switches, and gateway computers. The communications network may include connections, such as wire, wireless communication links, or fiber optic cables. A communications network may represent a worldwide collection of networks and gateways, such as the Internet, that use various protocols to communicate with one another, such as Lightweight Directory Access Protocol (LDAP), Transport Control Protocol/Internet Protocol (TCP/IP), Hypertext Transport Protocol (HTTP), Wireless Application Protocol (WAP), etc. A network may also include a number of different types of networks, such as, for example, an intranet, a local area network (LAN), or a wide area network (WAN).

In one example, a computer can use a network which may access a website on the Web (World Wide Web) using the Internet. In one embodiment, a computer 1010, including a mobile device, can use a communications system or network 1200 which can include the Internet, or a public switched telephone network (PSTN) for example, a cellular network. The PSTN may include telephone lines, fiber optic cables, microwave transmission links, cellular networks, and communications satellites. The Internet may facilitate numerous searching and texting techniques, for example, using a cell phone or laptop computer to send queries to search engines via text messages (SMS), Multimedia Messaging Service (MMS) (related to SMS), email, or a web browser. The search engine can retrieve search results, that is, links to websites, documents, or other downloadable data that correspond to the query, and similarly, provide the search results to the user via the device as, for example, a web page of search results.

Referring to FIG. 7, an example system 1500 for use with the embodiments of the present disclosure is depicted. The system 1500 includes a plurality of components and elements connected via a system bus 1504 (also referred to as a bus). At least one processor (CPU) 1510, is connected to other components via the system bus 1504. A cache 1570, a Read Only Memory (ROM) 1512, a Random Access Memory (RAM) 1514, an input/output (I/O) adapter 1520, a sound adapter 1530, a network adapter 1540, a user interface adapter 1552, a display adapter 1560 and a display device 1562, are also operatively coupled to the system bus 1504 of the system 1500.

One or more storage devices 1522 are operatively coupled to the system bus 1504 by the I/O adapter 1520. The storage device 1522, for example, can be any of a disk storage device (e.g., a magnetic or optical disk storage device), a solid state magnetic device, and so forth. The storage device 1522 can be the same type of storage device or different types of storage devices. The storage device can include, for example, but not limited to, a hard drive or flash memory and be used to store one or more programs 1524 or applications 1526. The programs and applications are shown as generic components and are executable using the processor 1510. The program 1524 and/or application 1526 can include all of, or part of, programs or applications discussed in the present disclosure, as well vice versa, that is, the program 1524 and the application 1526 can be part of other applications or program discussed in the present disclosure. The storage device can communicate with the control system 70 which has various functions as described in the present disclosure.

A speaker 1532 is operatively coupled to system bus 1504 by the sound adapter 1530. A transceiver 1542 is operatively coupled to system bus 1504 by the network adapter 1540. A display 1562 is operatively coupled to the system bus 1504 by the display adapter 1560.

One or more user input devices 1550 are operatively coupled to the system bus 1504 by the user interface adapter 1552. The user input devices 1550 can be, for example, any of a keyboard, a mouse, a keypad, an image capture device, a motion sensing device, a microphone, a device incorporating the functionality of at least two of the preceding devices, and so forth. Other types of input devices can also be used, while maintaining the spirit of the present invention. The user input devices 1550 can be the same type of user input device or different types of user input devices. The user input devices 1550 are used to input and output information to and from the system 1500.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures of the present disclosure illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be accomplished as one step, executed concurrently, substantially concurrently, in a partially or wholly temporally overlapping manner, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 8:
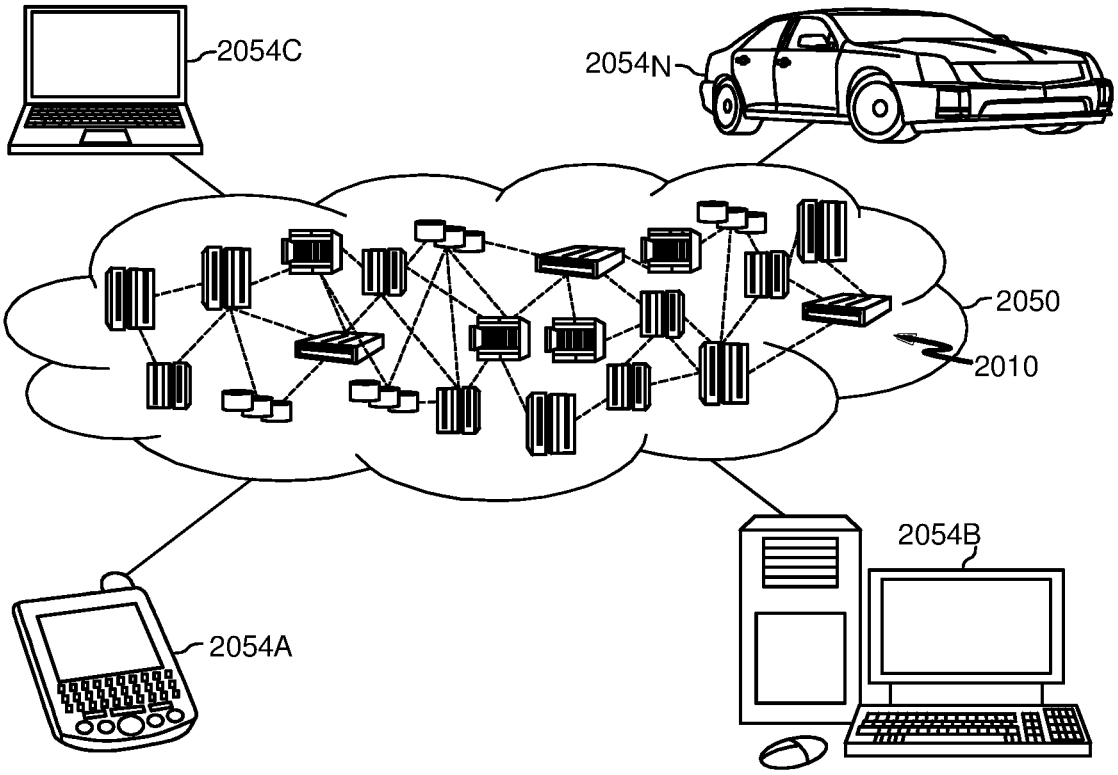
FIG. 8 is a block diagram depicting a cloud computing environment according to an embodiment of the present invention.

Referring now to FIG. 8, illustrative cloud computing environment 2050 is depicted. As shown, cloud computing environment 2050 includes one or more cloud computing nodes 2010 with which local computing devices used by cloud consumers, such as, for example, personal digital assistant (PDA) or cellular telephone 2054A, desktop computer 2054B, laptop computer 2054C, and/or automobile computer system 2054N may communicate. Nodes 2010 may communicate with one another. They may be grouped (not shown) physically or virtually, in one or more networks, such as Private, Community, Public, or Hybrid clouds as described hereinabove, or a combination thereof. This allows cloud computing environment 2050 to offer infrastructure, platforms and/or software as services for which a cloud consumer does not need to maintain resources on a local computing device. It is understood that the types of computing devices 2054A-N shown in FIG. 8 are intended to be illustrative only and that computing nodes 2010 and cloud computing environment 2050 can communicate with any type of computerized device over any type of network and/or network addressable connection (e.g., using a web browser).

Figure 9:
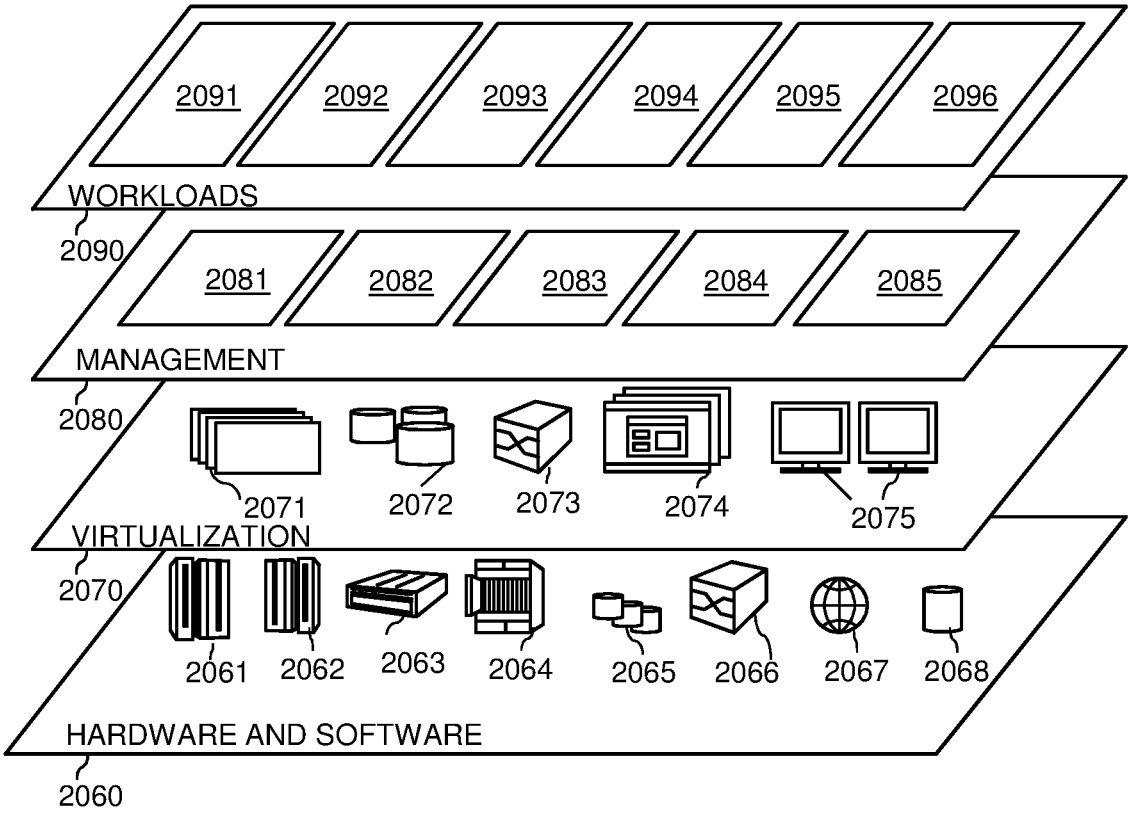
FIG. 9 is a block diagram depicting abstraction model layers according to an embodiment of the present invention.

Referring now to FIG. 9, a set of functional abstraction layers provided by cloud computing environment 2050 (FIG. 8) is shown. It should be understood in advance that the components, layers, and functions shown in FIG. 9 are intended to be illustrative only and embodiments of the invention are not limited thereto. As depicted, the following layers and corresponding functions are provided:

Hardware and software layer 2060 includes hardware and software components. Examples of hardware components include: mainframes 2061; RISC (Reduced Instruction Set Computer) architecture based servers 2062; servers 2063; blade servers 2064; storage devices 2065; and networks and networking components 2066. In some embodiments, software components include network application server software 2067 and database software 2068.

Virtualization layer 2070 provides an abstraction layer from which the following examples of virtual entities may be provided: virtual servers 2071; virtual storage 2072; virtual networks 2073, including virtual private networks; virtual applications and operating systems 2074; and virtual clients 2075.

In one example, management layer 2080 may provide the functions described below. Resource provisioning 2081 provides dynamic procurement of computing resources and other resources that are utilized to perform tasks within the cloud computing environment. Metering and Pricing 2082 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 2083 provides access to the cloud computing environment for consumers and system administrators. Service level management 2084 provides cloud computing resource allocation and management such that required service levels are met. Service Level Agreement (SLA) planning and fulfillment 2085 provide pre-arrangement for, and procurement of, cloud computing resources for which a future requirement is anticipated in accordance with an SLA.

Workloads layer 2090 provides examples of functionality for which the cloud computing environment may be utilized. Examples of workloads and functions which may be provided from this layer include: mapping and navigation 2091; software development and lifecycle management 2092; virtual classroom education delivery 2093; data analytics processing 2094; transaction processing 2095; and using a mobile device, for automatic retrieval, of a previously known access code for a security device 2096.

The descriptions of the various embodiments of the present invention have been presented for purposes of illustration, but are not intended to be exhaustive or limited to the embodiments disclosed. Likewise, examples of features or functionality of the embodiments of the disclosure described herein, whether used in the description of a particular embodiment, or listed as examples, are not intended to limit the embodiments of the disclosure described herein, or limit the disclosure to the examples described herein. Such examples are intended to be examples or exemplary, and non-exhaustive. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-implemented method for automatic retrieval, using a mobile device, of a previously known access code for a security device, comprising:

identifying, using a computer, a security mechanism based on a proximity of a user to the security mechanism, the proximity of the user to the security mechanism being determined using location services for a mobile device of the user and first historical data which indicates a location of the security mechanism;

analyzing second historical data, in response to identifying the security mechanism, the analysis of the second historical data to identify an access code related to the security mechanism at the location, the second historical data including content data from communications by the user, and the analysis of the second historical data including matching reference content from the content data to an access code for the security mechanism;

selecting an identified access code based on the analysis of the second historical data, the selecting of the identified access code including a reference relationship between the reference content, the security mechanism, and the access code, wherein the access code is referenced as being for the security mechanism; and providing the identified access code to the mobile device of the user for communication to the user, for the user to enter the code on the security mechanism.

2. The method of claim 1, further comprising:

receiving at the computer, historical data of user locations via the mobile device of the user.

3. The method of claim 1, wherein the security mechanism is one of a plurality of security mechanism, and the method further comprising:

recording, using the computer, access codes related to the plurality of security mechanisms each requiring an access code at a respective physical location, and used by the user.

4. The method of claim 1, further comprising:

receiving the location of the mobile device to determine a location of the user;

analyzing the first historical data to determine a location of the security mechanism; and analyzing the location of the user and the location of the security mechanism to determine the proximity of the user to the security mechanism.

5. The method of claim 1, wherein the analyzing of the second historical data is in response to the location of the user meeting a threshold for proximity to a security mechanism of a plurality of security mechanisms.

6. The method of claim 1, wherein the analysis of the second historical data includes analyzing communications on the mobile device of the user.

7. The method of claim 6, wherein the communications are from a group consisting of: SMS, Email, Instant messages, navigation software.

8. The method of claim 1, wherein the analyzing of the second historical data includes finding an access code based on a criteria, the criteria including a plurality of factors for matching reference content from the content data referencing the security mechanism to a code, and selecting a matched access code based on the criteria for the security mechanism.

9. The method of claim 1, wherein identifying the access code includes using natural language processing for the analyzing of the second historical data to identify the access code in a message about the security mechanism from a communication by the user using the mobile device.

10. The method of claim 1, wherein the providing of the identified access code to the mobile device of the user for communication to the user, is for the user to enter the code on the security mechanism;

in response to the identified access code being communicated to the user, the user entering the access code, and in response to the user entering the access code the security mechanism being opened and/or a secure area or venue being accessed which is secured by the security mechanism.

11. The method of claim 1, further comprising:

communicating the access code to the user using the mobile device; and displaying the access code on a screen of the mobile device.

12. The method of claim 1, further comprising:

identifying a plurality of access codes using the analysis of the second historical data;

based on criteria, weighting each of the identified codes for accuracy of being a correct code for the security mechanism; and selecting an access code from the plurality of access codes having meeting a threshold for the weighting for accuracy.

13. The method of claim 12, wherein the criteria includes determining a latest incident of communication for a code in the communications by the user, and/or determining a definitive expression of the code in a communication of the communication by the user.

14. The method of claim 12, evaluating the access codes for a highest probability of being a correct code for the security mechanism using a plurality of factors as part of the criteria;

determining a code of the plurality of codes with a highest probability of being a correct code based on the factors; and selecting the access code with the highest probability.

15. The method of claim 14, wherein the plurality of factors include using natural language processing to match a code in a message to the security mechanism.

16. The method of claim 1, wherein the code is a plurality of numbers.

17. The method of claim 1, wherein the security mechanism is securing a door or a gate.

18. The method of claim 1, wherein the security mechanism is securing access to a controlled facility or venue.

19. A system for automatic retrieval, using an electronic device, of a previously known access code for a security device, which comprises:

a computer system comprising; a computer processor, a computer-readable storage medium, and program instructions stored on the computer-readable storage medium being executable by the processor, to cause the computer system to perform the following functions to;

identify, using a computer, a security mechanism based on a proximity of a user to the security mechanism, the proximity of the user to the security mechanism being determined using location services for a mobile device of the user and first historical data which indicates a location of the security mechanism;

analyze second historical data, in response to identifying the security mechanism, the analysis of the second historical data to identify an access code related to the security mechanism at the location, the second historical data including content data from communications by the user, and the analysis of the second historical data including matching reference content from the content data to an access code for the security mechanism;

select an identified access code based on the analysis of the second historical data, the selecting of the identified access code including a reference relationship between the reference content, the security mechanism, and the access code, wherein the access code is referenced as being for the security mechanism; and provide the identified access code to the mobile device of the user for communication to the user, for the user to enter the code on the security mechanism.

20. A computer program product for automatic retrieval, using an electronic device, of a previously known access code for a security device, the computer program product comprising a computer readable storage medium having program instructions embodied therewith, the program instructions executable by a computer to cause the computer to perform functions, by the computer, comprising the functions to:

identify, using a computer, a security mechanism based on a proximity of a user to the security mechanism, the proximity of the user to the security mechanism being determined using location services for a mobile device of the user and first historical data which indicates a location of the security mechanism;

analyze second historical data, in response to identifying the security mechanism, the analysis of the second historical data to identify an access code related to the security mechanism at the location, the second historical data including content data from communications by the user, and the analysis of the second historical data including matching reference content from the content data to an access code for the security mechanism;

select an identified access code based on the analysis of the second historical data, the selecting of the identified access code including a reference relationship between the reference content, the security mechanism, and the access code, wherein the access code is referenced as being for the security mechanism; and provide the identified access code to the mobile device of the user for communication to the user, for the user to enter the code on the security mechanism.

* * * * *